US008250799B2

(12) United States Patent
Duperry et al.

(10) Patent No.: US 8,250,799 B2
(45) Date of Patent: Aug. 28, 2012

(54) METHOD AND APPARATUS FOR TRIGGER ASSEMBLIES FOR FIREARMS

(75) Inventors: Peter A. Duperry, Cheshire, CT (US); Joseph H. Bartozzi, Woodbridge, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 417 days.

(21) Appl. No.: 12/509,536

(22) Filed: Jul. 27, 2009

(65) Prior Publication Data

US 2010/0024273 A1 Feb. 4, 2010

Related U.S. Application Data

(60) Provisional application No. 61/137,724, filed on Jul. 31, 2008.

(51) Int. Cl.
*F41A 17/56* (2006.01)

(52) U.S. Cl. ..... 42/70.04; 42/42.02

(58) Field of Classification Search ..... 42/70.01, 42/70.04, 70.05, 70.06, 42.02
See application file for complete search history.

(56) References Cited

U.S. PATENT DOCUMENTS

| | | | | |
|---|---|---|---|---|
| 2,249,232 | A | 7/1941 | Smith | |
| 2,584,299 | A | 2/1952 | Sefried, II | |
| 3,731,416 | A | 5/1973 | Semple | |
| 3,747,251 | A | 7/1973 | Baker | |
| 4,017,996 | A | 4/1977 | Liedke | |
| 4,058,924 | A | 11/1977 | Mullner | |
| 4,569,145 | A * | 2/1986 | Ruger et al. | 42/16 |
| 4,667,429 | A | 5/1987 | Perazzi | |
| 4,671,005 | A | 6/1987 | Jewell | |
| 4,691,461 | A | 9/1987 | Behlert | |
| 4,908,970 | A | 3/1990 | Bell | |
| 5,012,604 | A | 5/1991 | Rogers | |
| 5,487,233 | A | 1/1996 | Jewell | |
| 5,560,134 | A * | 10/1996 | Van Niekerk et al. | 42/70.06 |
| 6,073,380 | A | 6/2000 | Hauser et al. | |
| 6,131,324 | A | 10/2000 | Jewell | |
| 6,164,001 | A | 12/2000 | Lee | |
| 6,212,812 | B1 * | 4/2001 | Aigner | 42/70.06 |
| 6,415,539 | B1 | 7/2002 | Fuchs et al. | |
| 6,553,706 | B1 | 4/2003 | Gancarz et al. | |
| 6,640,479 | B2 | 11/2003 | Gühring et al. | |
| 6,681,511 | B1 | 1/2004 | Huber | |

(Continued)

FOREIGN PATENT DOCUMENTS

DE 2263888 7/1973

*Primary Examiner* — Benjamin P Lee
(74) *Attorney, Agent, or Firm* — Holland & Bonzagni, P.C.; Donald S. Holland, Esq.

(57) ABSTRACT

Applicants have disclosed an improved trigger assembly for firearms, and a related method, to avoid premature firing after an unintentional trigger pull, especially where light trigger pulls have previously been set. In the preferred embodiment, Applicants' trigger assembly has two non-coaxial triggers: a slotted primary trigger and a secondary trigger which can pivot into the slot. During an intentional trigger pull, the shooter's finger initially pushes against the secondary trigger until it pivots and nestles within the primary trigger's slot. Continued pulling on both the secondary and primary triggers causes a sear to fall off the primary trigger and the firearm to discharge. In an unintentional trigger pull, where the secondary trigger is not pulled back enough to nestle within the primary trigger's slot, a protrusion on the secondary trigger blocks the sear from falling, thereby avoiding discharge.

6 Claims, 4 Drawing Sheets

U.S. PATENT DOCUMENTS 6,705,036 B2 3/2004 Orr
6,772,548 B1 8/2004 Power
6,820,606 B1 11/2004 Duffey
6,843,013 B2 * 1/2005 Cutini et al. ..... 42/70.06
6,978,568 B2 12/2005 Jewell
7,047,685 B2 5/2006 Diaz et al.
7,051,467 B1 5/2006 Huber
7,165,352 B2 1/2007 Langlotz
7,188,561 B1 3/2007 Kelbly
7,243,452 B2 7/2007 Zeh
7,252,504 B2 * 8/2007 Lin ..... 431/153
7,331,136 B2 2/2008 Geissele
7,398,723 B1 7/2008 Blakley
D597,626 S * 8/2009 Krieger ..... D22/108
2003/0213159 A1 * 11/2003 Cutini et al. ..... 42/70.06

* cited by examiner

METHOD AND APPARATUS FOR TRIGGER ASSEMBLIES FOR FIREARMS

RELATED APPLICATION

This application claims priority from U.S. Provisional Patent Application Ser. No. 61/137,724, filed Jul. 31, 2008. Applicants incorporate that provisional application herein by reference.

FIELD OF INVENTION

This invention relates generally to firearms. More specifically, it relates to trigger assemblies for firearms.

BACKGROUND OF INVENTION

Trigger assemblies in firearms are often adjusted for both hunting and competitive shooting. Lighter trigger pulls (i.e., trigger pull forces for discharges) may be preferred for competition or hunting to ensure quicker or more accurate shots. Shooters often want to adjust the trigger force to their own preference, depending upon their particular application.

Some long guns, such as rifles, have come equipped for years with set screws for trigger adjustment. Turning a set screw clockwise typically increases the compression of a coil spring, which rests against a trigger stem inside a receiver housing. That creates a heavier trigger pull. Letting up on the spring, by turning the screw counterclockwise, lightens the trigger pull.

Sometimes, shooters make unauthorized and non-advisable modifications in order to lessen trigger pull force. Certain modifications can create very light trigger pull forces, but can also cause potential safety problems. Firearm manufacturers neither recommend nor sanction this approach.

Many different types of adjustable trigger assemblies have been patented, such as: U.S. Pat. No. 2,249,232 to Smith: U.S. Pat. No. 4,667,429 to Perazzi; U.S. Pat. No. 4,671,005 to Jewell; U.S. Pat. No. 4,691,461 to Behlert; U.S. Pat. No. 4,908,970 to Bell; U.S. Pat. No. 5,012,604 to Rogers; U.S. Pat. No. 5,487,233 to Jewell; U.S. Pat. No. 6,131,324 to Jewell; U.S. Pat. No. 6,164,001 to Lee; U.S. Pat. No. 6,553,706 to Gancarz et al.; U.S. Pat. No. 6,978,568 to Jewell; U.S. Pat. No. 7,047,685 to Diaz et al.; and U.S. Pat. No. 7,165,352 to Langlotz. Several of these assemblies have many small interacting parts. Small parts are difficult to manufacture properly, which can lead to jamming or delayed functioning.

Accordingly, it is a principal object of the present invention to provide an improved trigger assembly for firearms to avoid premature firing after an unintentional trigger pull, where light trigger pulls have previously been set.

It is another principal object of the present invention to provide a related method for avoiding premature discharge of a firearm after an unintentional trigger pull, where light trigger pulls have previously been set It is another general object to provide an adjustable trigger assembly which has fewer parts and is easier to manufacture.

It is a more specific object to provide an adjustable trigger assembly, commensurate with the above-listed objects, which is durable to use.

SUMMARY OF INVENTION

Applicants have disclosed an improved trigger assembly, and a related method, for avoiding premature discharge in firearms such as shotguns and rifles. In the preferred embodiment, Applicants' trigger assembly comprises: a modified standard trigger having a central elongated slot or throughbore; a second trigger pivotally mounted within the slot; a notch or shoulder, atop the first trigger, on which a sear rests during a cocked position of a hammer or striker; and a ledge atop the second trigger, inside the firearm's housing, which interacts with a "blind" hole or bore in the underside of the sear to prevent the safety trigger blade from rotating out from under the sear after an unintentional rotation of the trigger. Both the first and second triggers are mounted on separate, non-coaxial pivot pins.

During a desired trigger pull, the shooter pulls backs on both the first and second triggers. Initially, the second trigger rotates and nestles into the first trigger's slot, until the front faces of the blades for both triggers 12, 14 are flush. Continued pulling trips the sear off the first trigger's notch to enable the striker to fall and discharge the weapon.

If instead the first trigger is jostled accidentally, the second trigger's ledge is designed to act as a catch within the sear's blind hole to prevent the discharge. Nothing is foolproof: for example, if the blades of both the first trigger and second trigger are jostled together, the firearm may discharge as though an intentional trigger pull has occurred.

In its broadest sense, Applicants' related method can be thought of as: avoiding a premature discharge of a firearm, upon an unintentional jostling of a first trigger, by temporarily housing a protrusion on a second trigger within a bore on the underside of a sear to block the sear from falling; and wherein the triggers are mounted on non-coaxial pivot pins.

BRIEF DESCRIPTION OF DRAWINGS

The above and other objects will become more readily apparent when the following description is read in conjunction with the accompanying drawings, in which.

DETAILED DESCRIPTION OF PREFERRED EMBODIMENT

Figure 1B:
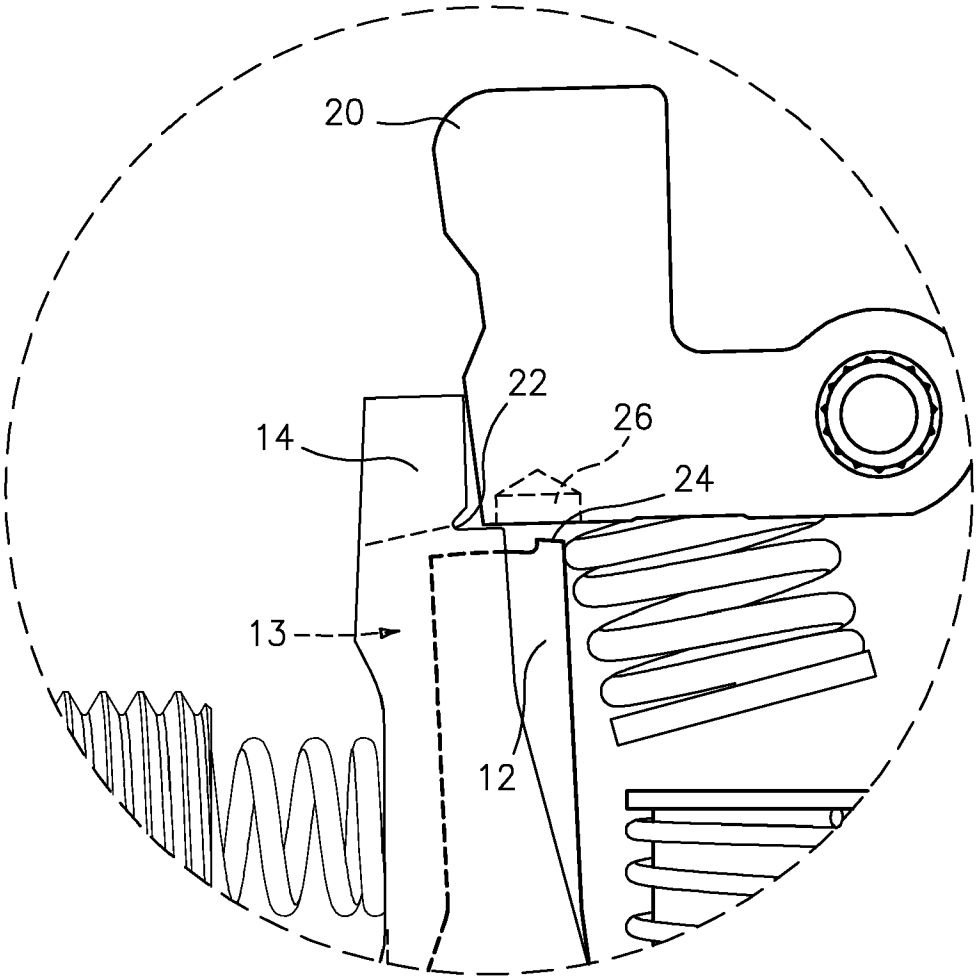
FIG. 1B shows an enlarged view of an encircled area in FIG. 1A.

Referring to the drawings in, detail FIGS. 1A, 1B, 2A, 2B, 3A, 3B, 4A, 4B illustrate Applicants' preferred embodiment of an adjustable trigger assembly, generally designated by reference numeral 10, for a long gun, such as a shotgun (not shown) or rifle. The Assignee, O.F. Mossberg & Sons, Inc., markets this product.

As shown, a preferred second or secondary trigger 12 is housed within an elongated central slot 13 or throughbore in a first or primary trigger 14, but the second trigger 12 is pivoted independently of the first trigger 14 upon a pin 16 supported by the trigger housing (not shown). The first trigger 14 is pivoted upon a separate pin 18, also supported by the trigger housing. Pins 16 and 18 are not coaxial. A pivotable sear 20 (located outside of the slot 13) rests upon a corresponding sear notch 22 of the first trigger 14, with the second trigger 12 directly beneath the sear surfaces.

Figure 3B:
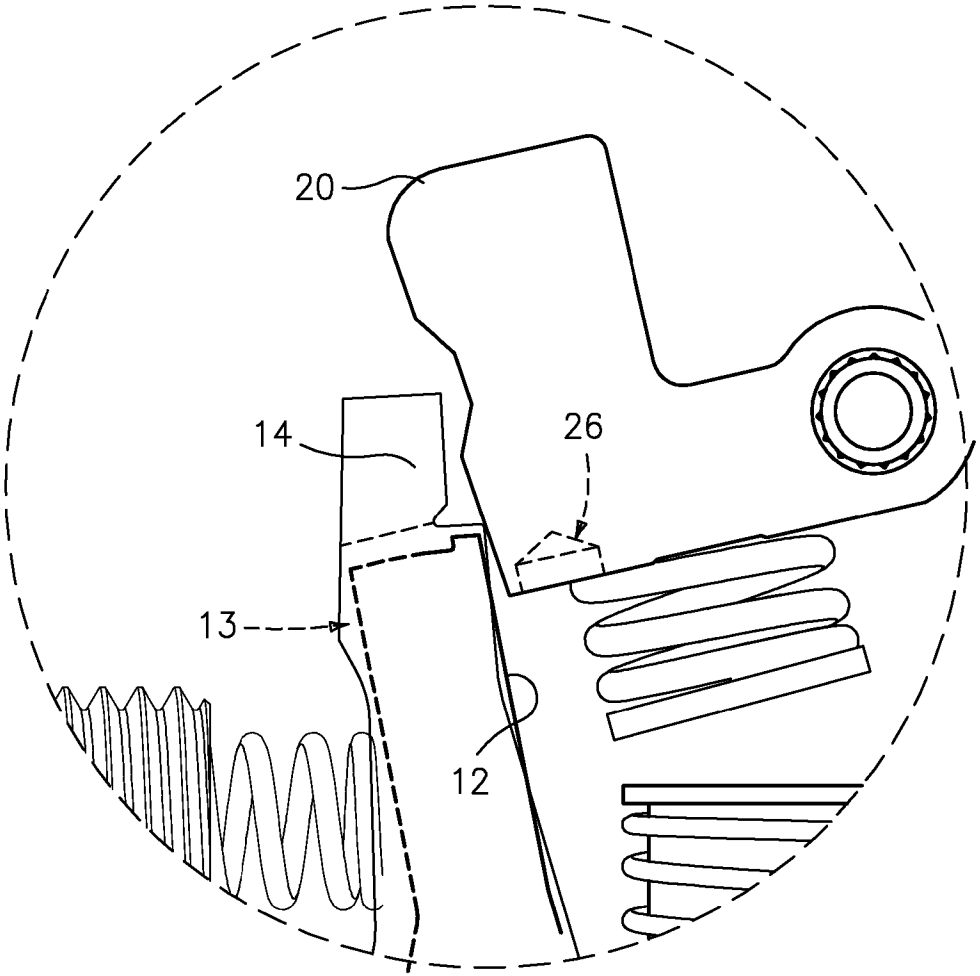
FIG. 3B is an enlarged view of an encircled area in FIG. 3A.
Figure 3A:
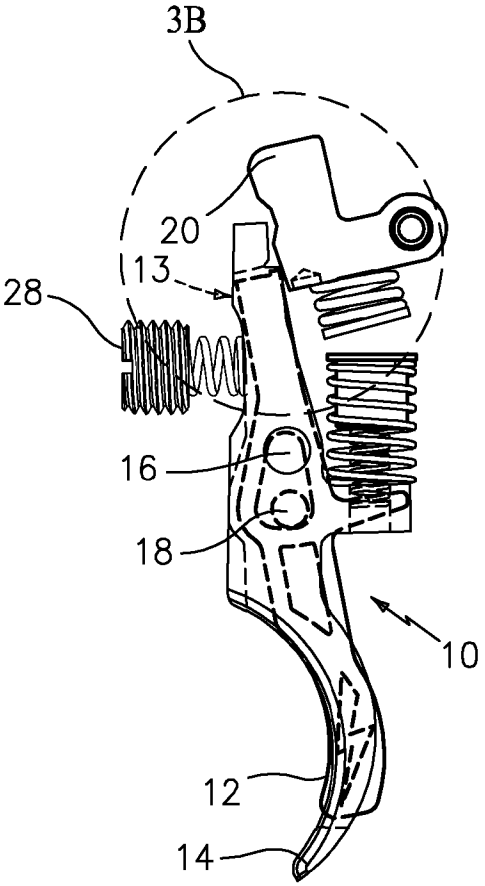
FIG. 3A illustrates Applicants' preferred trigger assembly after an intentional trigger rotation in which the second trigger has nestled within a slot of the first trigger to allow for a normal or full rotation of the two triggers.
Figure 4A:
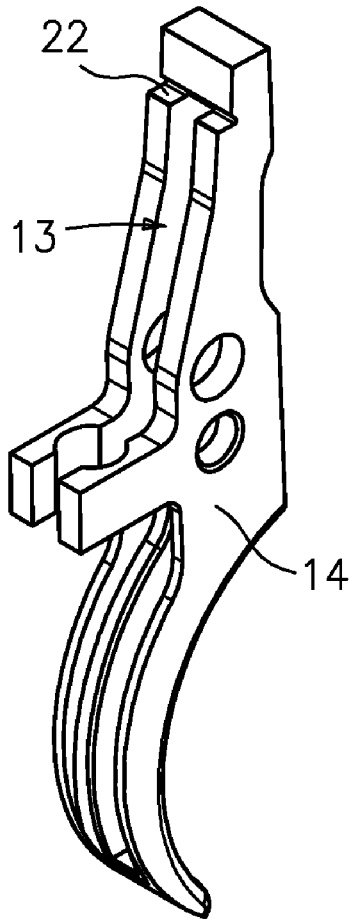
FIG. 4A is a rear view of the first trigger.
Figure 4B:
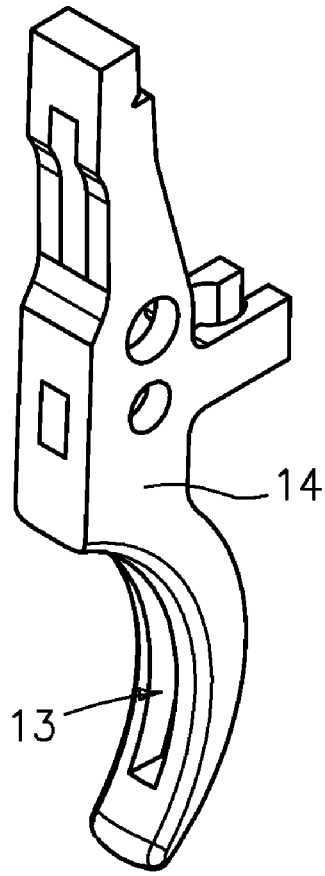
FIG. 4B is a front view of the first trigger.

During a normal, intentional trigger pull by a shooter, the exposed blade of the second trigger 12 is depressed by the shooter's trigger finger (not shown) until that blade is flush with the face of the first trigger 14 (see FIGS. 3A, 3B). At that point, the blade has nestled within the elongated slot 13 located, preferably centrally, in the first trigger 14. Increasing pressure upon the triggers 12, 14 causes them to pivot or rotate out from beneath the sear 20 (see FIGS. 3A, 3B), allowing the firearm to fire or discharge.

Figure 1A:
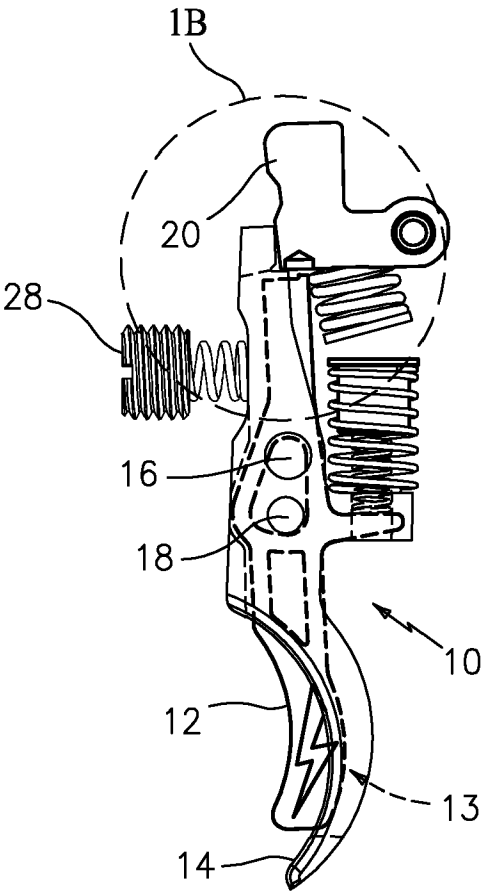
FIG. 1A illustrates a preferred embodiment of an adjustable trigger assembly, constructed in accordance with the present invention, wherein the trigger assembly is in an "at rest" condition.

FIGS. 1A, 1B show the trigger assembly 10 in an "at rest" position, after the discharge.

In the case of an unintentional rotation of the first trigger 14, the second trigger 12 blocks the movement of the sear 20 (see FIGS. 2A, 2B), thus preventing the release of the striker and discharge of the firearm. A protruding ledge or protrusion 24, which extends generally vertically atop the second trigger 12, engages a "blind" hole or bore 26 in the underside of the sear 20. This engagement or interlock prevents the second trigger 12 from rotating out from under the sear 20. The striker and fire control system must be reset before the firearm can be fired.

Figure 2B:
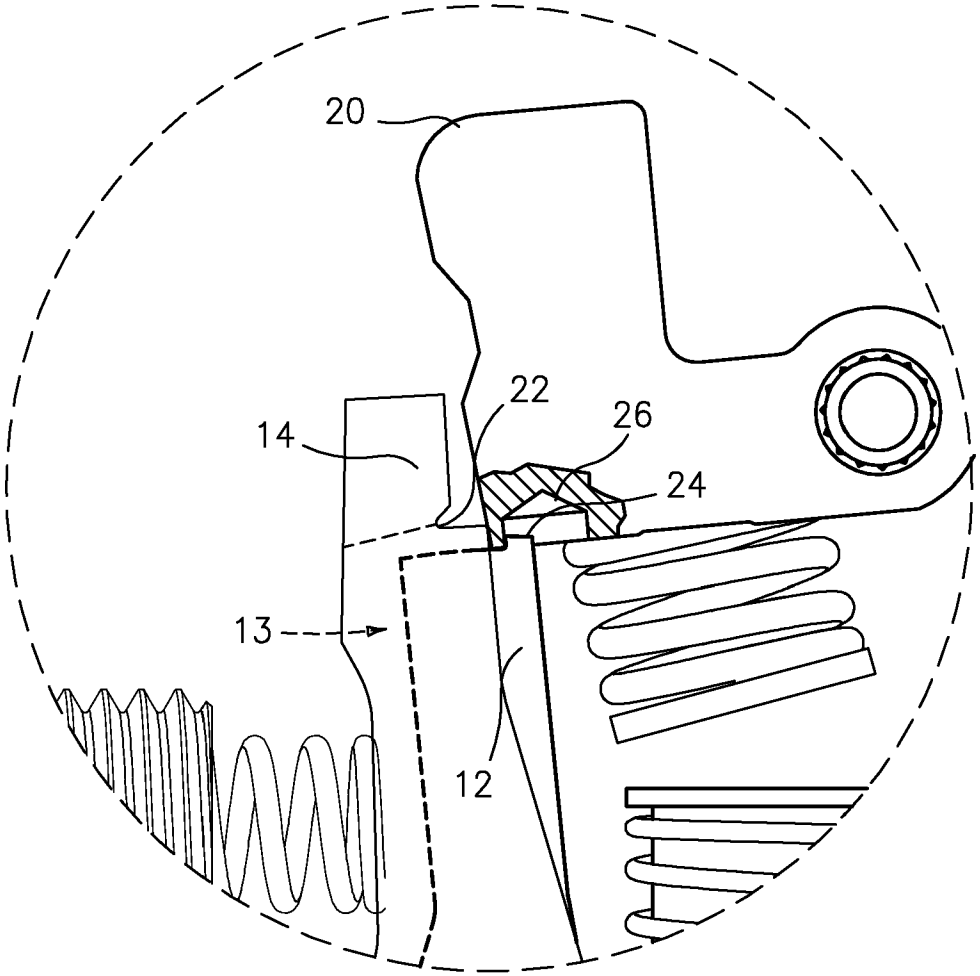
FIG. 2B is an enlarged view of an encircled area in FIG. 2A.
Figure 2A:
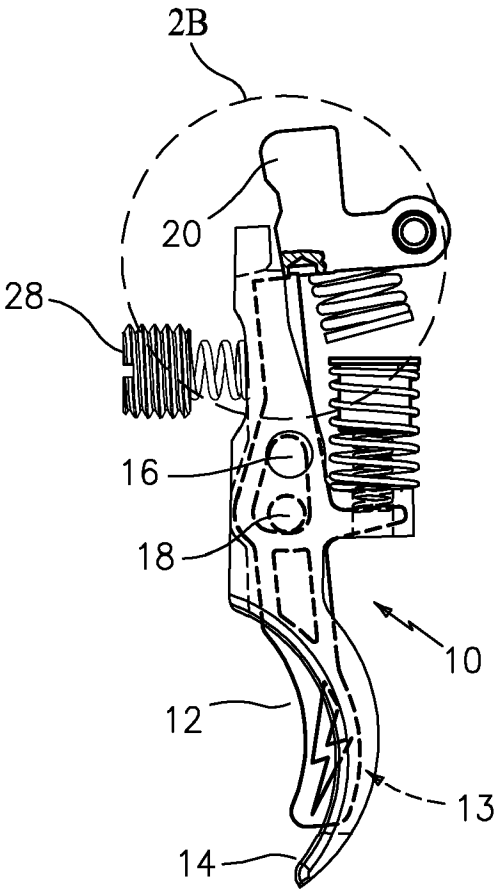
FIG. 2A illustrates the same adjustable trigger assembly after an unintentional rotation of the first trigger, but before a normal or complete trigger rotation, with Applicants' second trigger still holding up the sear.

The above-described interlock also avoids a discharge if the blade of the second trigger 12 is depressed slightly (i.e., not enough for full nesting) after an unintentional rotation or just a slight pull of trigger 12 (see FIGS. 2A and 2B). As best shown in FIGS. 1B and 2B, the "blind" hole or bore 26 is larger than the protrusion 24. That oversize allows for some play or rotational movement of protrusion 24 within bore 26 during a partial rotation of the second trigger 12, and a partial nestling of the blade of the second trigger, within slot 13 (see FIG. 2B). That play avoids a premature discharge of the firearm upon an unintentional partial rotation (e.g., due to jostling) of the second trigger 12, by allowing the protrusion 24 to move within the oversized bore during the partial rotation of the second trigger, to keep the second trigger from pivoting out from under the sear 20 and thereby prevent the firearm from firing.

The illustrated trigger assembly 10 was designed primarily for use in firearms already having an adjustable trigger assembly. By turning a set screw 28 either clockwise or counterclockwise, the compression of an associated spring 30 can be modified to adjust the trigger pull.

Shooters often set their trigger assemblies for a light trigger pull. This invention is designed to avoid premature or unintended discharge at light trigger pull settings. Applicants' slotted trigger 14, pivotable second trigger blade 12, and bored sear 20 therefore can be thought of as an avoidance means for avoiding premature or unintended discharge for light trigger pull settings in firearms.

It should be noted that Applicants' trigger assembly 10 may not be able to prevent all types of unintended or accidental discharges. For example, a heavy unbalanced force applied to the firearm or trigger(s) might override the interlock created by the protrusion 24 inside blind hole 26; or, if both blades of triggers 12, 14 are jostled together (e.g., a tree branch snags both), that might result in a discharge as though the triggers were intentionally pulled.

Applicants' invention can be thought of as a method comprising the following steps:

a. avoiding a premature discharge of a firearm, upon an unintentional jostling of a first trigger, by temporarily housing a protrusion on a second trigger within a bore on the underside of a sear to block the sear from falling; and
b. discharging the firearm, upon an intentional trigger pull, by:
   i. intentionally pulling and rotating a blade of a second firearm trigger until that blade nestles within a slot of a first firearm trigger; and
   ii. pulling the trigger together thereafter to rotate the triggers out from beneath a sear, thereby allowing the sear to fall and the firearm to discharge; and
c. wherein the triggers are mounted on non-coaxial pivot pins.

Applicants' method, in its broadest sense, can be thought of as steps a. and c.

It should be understood by those skilled in making firearms that obvious structural modifications can be made to the depicted embodiment without departing from the spirit of the invention. For example, the trigger assembly 10 could be adapted for use in shotguns. In addition, the trigger assembly could be adapted for use in firearms without adjustable trigger pulls.

We claim:

1. A trigger assembly for firearms comprising:
a. a first trigger, which is pivotally mounted on a first pivot pin, wherein the first trigger has
   i. at least one vertically extending slot; and
   ii. a shoulder, which is adapted in size and shape for a sear, which is located outside the slot, to rest on the shoulder during a cocked position of a striker;
b. a second trigger, which is pivotally mounted within the slot on a second pivot pin which is not coaxial with the first pivot pin, wherein the second trigger has a protrusion, which extends substantially vertically atop the second trigger; and
c. the sear has a bore in the underside of the sear, wherein:
   i. the bore is adapted in size and shape to house the protrusion; and
   ii. the width of the bore is at least 50% larger than the width of the protrusion to allow for rotational movement of the protrusion within the bore, during a partial unintentional rotation of the second trigger within the slot, to keep the second trigger from pivoting out from under the sear and thereby prevent the firearm from firing.

2. The trigger assembly of claim 1 wherein the shoulder is located adjacent an upper portion of the first trigger.

3. In an adjustable trigger assembly for a firearm, of the type having a pivotable trigger and an adjustment screw for adjusting the amount of trigger pull force necessary to discharge the firearm, the improvement comprising:
a. avoidance means for avoiding a premature discharge caused by an unintentional rotation of a trigger, wherein the avoidance means comprises:
   i. a first trigger having an elongated slot;
   ii. a second trigger pivotable within the slot, wherein a protruding ledge extends generally vertically atop the second trigger;
   iii. a sear, located outside the slot, having a bore on the underside of the sear, wherein the bore is adapted in size and shape to house the ledge during an unintentional rotation of the first trigger;
   iv. the width of the bore is at least 50% larger than the width of the protrusion to allow for rotational movement of the ledge within the bore, during an unintentional partial rotation of the second trigger within the slot of the first trigger, to keep the second trigger from pivoting out from under the sear and thereby prevent the firearm from prematurely firing;

iv. both the first trigger and the second trigger are pivotally mounted on non-coaxial pins; and v. the second trigger is designed in size and shape to nestle into the first trigger, only during an intentional rotation of the first and second triggers, to allow discharge of the firearm.

4. A method comprising:

a. avoiding a premature discharge of a firearm, upon an unintentional jostling of a first trigger, by temporarily housing a protruding ledge atop a second trigger within a bore on the underside of a sear to block the sear from falling;

b. avoiding a premature discharge of a firearm, upon an unintentional partial rotation of a blade of the second trigger within a central slot of the first trigger, by allowing the ledge to move rotationally within the bore during the partial rotation of the blade of the second trigger, to keep the second trigger from pivoting out from under the sear and thereby prevent the firearm from prematurely firing;

i. wherein the bore is located outside the slot; and ii. wherein the width of the bore is at least 50% larger than the width of the ledge;

c. discharging the firearm, upon an intentional trigger pull, by:

i. intentionally pulling and rotating the blade of the second trigger until that blade nestles within the slot of the first trigger; and ii. pulling the trigger together thereafter to rotate the triggers out from beneath the sear, thereby allowing the sear to fall and the firearm to discharge;

d. wherein the triggers are mounted on non-coaxial pivot pins.

5. A method comprising:

a. avoiding a premature discharge of a firearm, upon an unintentional jostling of a first trigger, by temporarily housing a protruding ledge atop a second trigger within a bore on the underside of a sear to block the sear from falling;

b. wherein the width of the bore is at least 50% larger than the width of the ledge to allow for rotational movement of the ledge within the bore, during an unintentional partial rotation of the second trigger within a slot of the first trigger, to keep the second trigger from pivoting out from under the sear and thereby prevent the firearm from prematurely firing; and c. wherein the triggers are mounted on non-coaxial pivot pins.

6. A trigger assembly for firearms comprising:

a. a first trigger, which is pivotally mounted on a first pivot pin, wherein the first trigger has:

i. at least one vertically extending slot; and ii. a shoulder, which is adapted in size and shape for a sear, which is located outside the slot, to rest on the shoulder during a cocked position of a striker;

b. a second trigger, which is pivotally mounted within the slot on a second pivot pin which is not coaxial with the first pivot pin, wherein the second trigger has a protrusion; and c. the sear has a bore in the underside of the sear, wherein:

i. the width of the bore is at least 50% larger than the width of the protrusion to allow for rotational movement of the protrusion within the bore during an unintentional partial rotation of the second trigger within the slot, to keep the second trigger from pivoting out from under the sear and thereby prevent the firearm from firing.

* * * * *